US005293832A

United States Patent [19]

Potter, Jr.

[11] Patent Number: 5,293,832

[45] Date of Patent: Mar. 15, 1994

[54] OUTBOARD MOTOR MOUNTING SYSTEM

[76] Inventor: William S. Potter, Jr., 4235 Douglas Rd., Coconut Grove, Fla. 33133

[21] Appl. No.: 945,216

[22] Filed: Sep. 15, 1992

[51] Int. Cl.[5] ..... B63H 5/12

[52] U.S. Cl. ..... 114/364; 114/343; 114/362; 248/641; 248/640

[58] Field of Search ..... 114/343, 364, 362, 655, 114/85, 182; 248/235, 640-643

[56] References Cited

U.S. PATENT DOCUMENTS

| | | | |
|---|---|---|---|
| 1,800,556 | 4/1931 | Mead | 114/182 |
| 1,861,048 | 5/1932 | Conover | 114/355 |
| 2,660,142 | 11/1953 | Swenson | 114/182 |
| 2,764,119 | 9/1956 | Sigler | 115/17 |
| 2,842,086 | 7/1958 | Yost | 115/0.5 |
| 2,886,462 | 5/1959 | Jagiel | 115/17 |
| 2,926,362 | 3/1960 | Collins, Jr. et al. | 9/1 |
| 4,000,712 | 1/1977 | Erikson et al. | 114/77 R |
| 4,302,195 | 11/1981 | Bryant | 248/640 |
| 4,708,087 | 11/1987 | Potter | 114/343 |
| 4,723,928 | 2/1988 | Riley | 248/640 |
| 4,742,795 | 5/1988 | DePrey | 114/362 |
| 4,813,365 | 3/1989 | Lindstrom et al. | 114/56 |
| 4,823,725 | 4/1989 | Smith | 114/343 |
| 4,895,095 | 1/1990 | Potter, Jr. | 114/343 |
| 5,009,619 | 4/1991 | Meier | 440/53 |

*Primary Examiner*—Robert J. Oberleitner
*Assistant Examiner*—C. T. Bartz
*Attorney, Agent, or Firm*—Webb, Burden, Ziesenheim & Webb

[57] ABSTRACT

An outboard motor mounting system for mounting a motor on an outboard boat with a cutout transom. A transom sealing device is provided to seal the cutout of the outboard boat transom. The sealing device may include a mounting flange which is engagable with a horizontal motor well transom lip of the outboard boat to support and position the transom sealing means. The outboard motor mounting device includes a body and a swim platform which combine to form a substantially sealed hollow interior to provide buoyancy to the mounting device. The motor is attached to a mounting flange positioned at an uppermost portion of the body member.

15 Claims, 5 Drawing Sheets

OUTBOARD MOTOR MOUNTING SYSTEM

BACKGROUND OF THE INVENTION

1. Field of the Invention

This invention relates to devices which close the transom of a boat and which permit one or more outboard motors to be mounted behind the boat transom.

2. Description of the Prior Art

An outboard motor boat is often provided with a low cut or open transom which is very susceptible to water boarding the boat's cockpit by flowing through the motor well. This is particularly true when drifting in rough water due to the drag of the outboard engine's lower unit combined with the windage of the hull which causes the boat to be oriented with its stern to windward and the oncoming waves.

U.S. Pat. No. 2,926,362 discloses a device for sealing an open transom of a boat by forming a shield of canvas or the like over the open transom. The motor is mounted directly to the closed-in transom. Advantages have been found in mounting a motor further aft of the boat transom. U.S. Pat. Nos. 4,813,365; 4,000,712; 2,886,462; 2,842,086 and 2,764,119 disclose various boat attachments for mounting of one or more external motors aft of the transom. But these devices do not seal the open transom.

In order to overcome many of the problems of the prior art devices, I developed an outboard motor mounting system as described in U.S. Pat. Nos. 4,895,095 and 4,708,087. My previous outboard motor mounting devices for mounting a motor aft of the transom section provides a buoyant motor mounting device, together with a transom sealing unit. However, my previous outboard motor mounting device is unique to specific configurations of boat hulls and has a limited range of applicability.

It is, therefore, an object of the present invention to overcome the deficiencies of the prior art and to provide an outboard motor mounting system which is applicable to a wide variety of boat hulls while maintaining all the advantages of a motor mounted behind the transom.

SUMMARY OF THE INVENTION

Accordingly, I have developed an outboard motor mounting system which includes a transom sealing bulkhead for sealing a cutout on an outboard motor boat's transom. The sealing bulkhead includes a mounting flange which is engagable with the horizontal motor well transom lip to support and position the transom sealing bulkhead. The mounting flange also serves to more easily position the entire motor mounting system. The outboard motor mounting system also includes a motor mounting device mounted to the transom, and optionally to the transom sealing bulkhead. A body and a swim platform combine together to form the motor mounting device with a substantially sealed hollow interior which provides buoyancy to the motor mounting device. The motor is attached to a mounting flange at a position above the swim platform to allow for the necessary clearance in the tilting of the motor. The body member includes a rear wall, with two opposed side walls spaced from each other attached to the rear wall, with a bottom surface extending between the side walls and attached to the rear wall, a mating front face spaced from the rear wall and attached to the side walls and the bottom surface, and the mounting flange located at an uppermost portion of the rear wall.

A door or bench may be provided in the transom sealing bulkhead. Rigging hatches may be provided in the swim platform to provide access to the hollow interior. Scupper relief pockets and a drain hole pocket may be formed in a front face of the body.

DESCRIPTION OF THE PREFERRED EMBODIMENT

Figure 1:
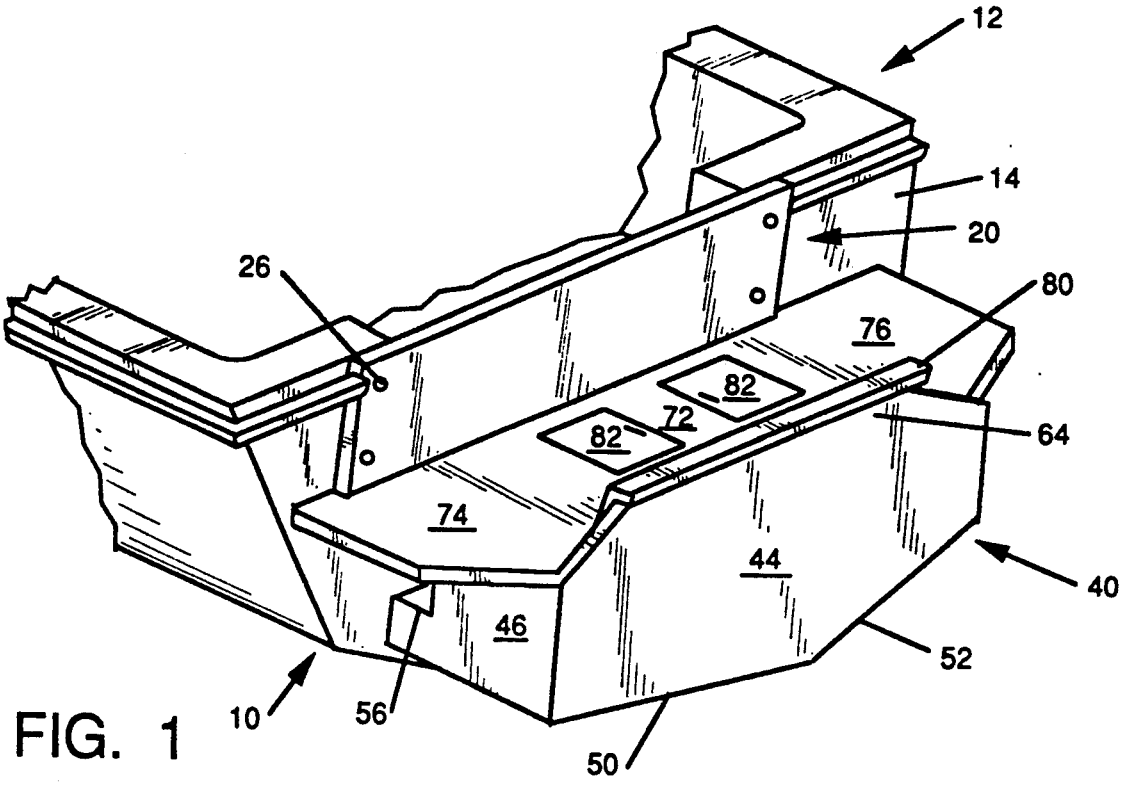
FIG. 1 is a perspective view of an outboard motor mounting system in accordance with the present invention and mounted to the rear of a boat.
Figure 2:
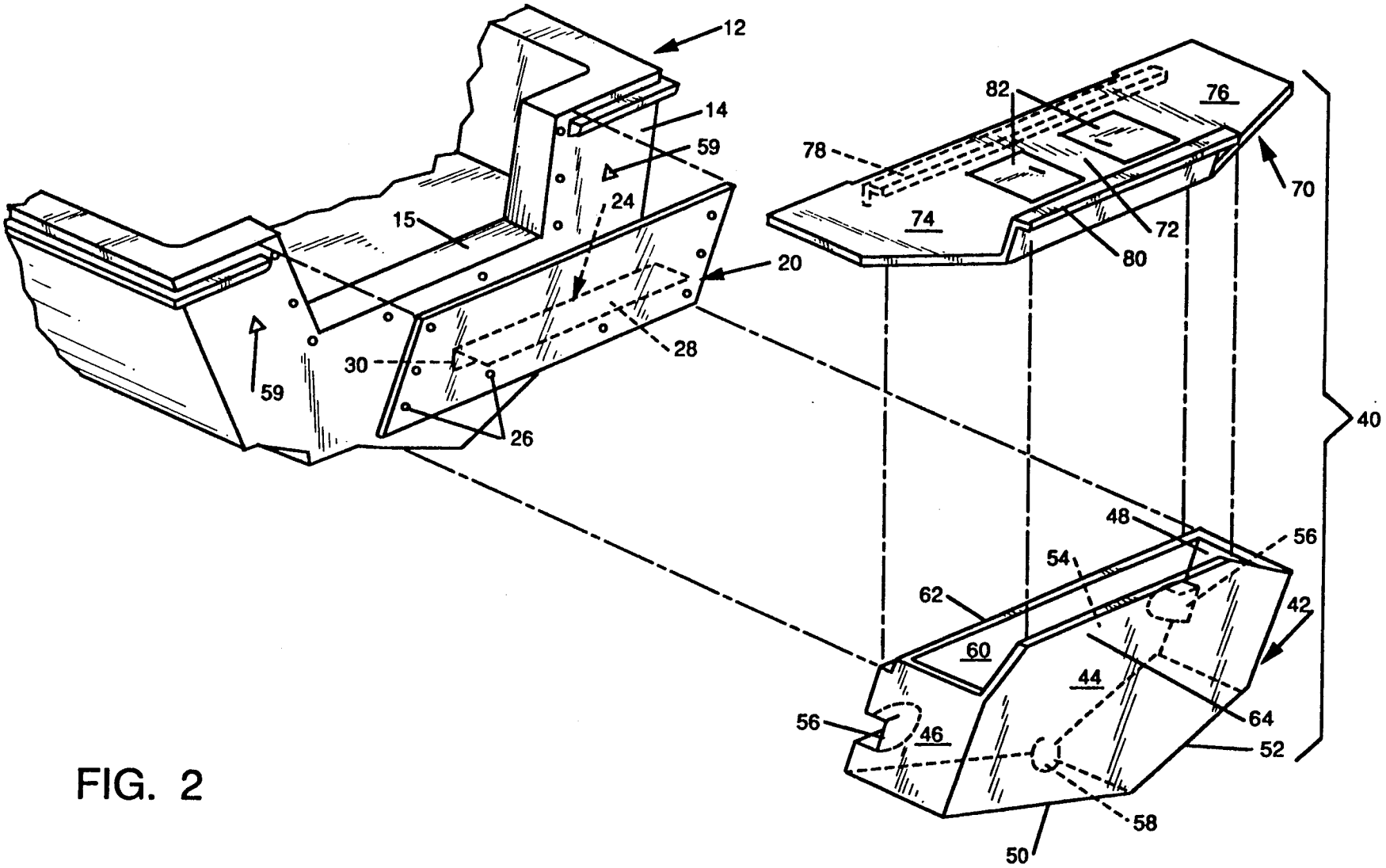
FIG. 2 is an exploded view of the outboard motor mounting system shown in FIG. 1.

A first embodiment of an outboard motor mounting system 10 in accordance with the present invention includes, as shown in FIGS. 1 and 2, a transom sealing bulkhead 20 and an outboard motor mounting device 40.

A typical outboard boat 12 includes a transom 14, as shown in FIGS. 1–2, which has a recessed area defined above a horizontal transom lip 15. The transom sealing bulkhead 20 overlays and substantially seals the recessed portion of the cutout transom 14 above the horizontal transom lip 15. The transom sealing bulkhead 20 includes a mounting flange assembly 24 attached thereto. The mounting flange assembly 24 is adapted to engage the horizontal transom lip 15 to position and support the transom sealing bulkhead 20 and may support the entire motor mounting system 10 in the desired position during initial installation. The transom sealing bulkhead 20 may include a plurality of bulkhead mounting holes 26 through which bolts or screws may be used to secure the transom sealing bulkhead 20 to the transom 14. After the transom sealing bulkhead 20 is adequately positioned adjacent the transom 14 by placing the flange assembly 24 in engagement with the horizontal transom lip 15, permanent mounting holes may be drilled in the transom 14 aligned with the bulkhead mounting holes 26.

Figure 3:
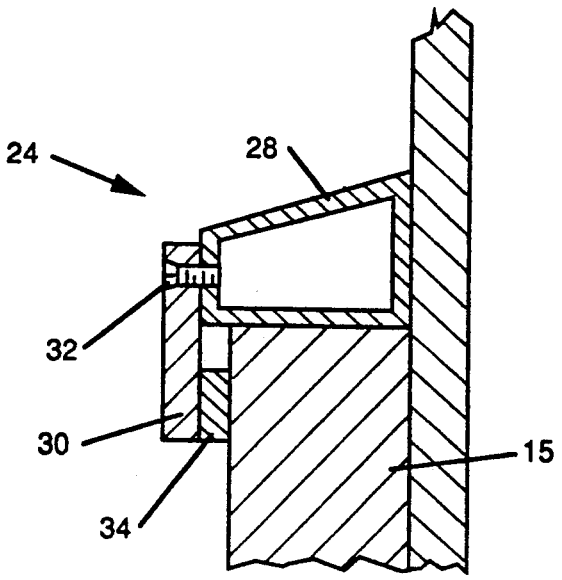
FIG. 3 is a cross section of a portion of the mounting flange assembly of the transom sealing bulkhead shown in FIGS. 1–2.

The mounting flange assembly 24 of the transom sealing bulkhead 20 is shown in FIG. 3 in greater detail. The flange assembly 24 includes a flange bracket 28 which is attached to the transom sealing bulkhead 20. A clamping bar 30 is attached to the flange bracket 28 through a clamping screw 32 which engages threads in the flange bracket 28. The flange bracket 28 is clamped securely in place by tightening down on the clamping screw 32 to securely clamp the transom 14 between the clamping bar 30 and the transom sealing bulkhead 20.

Shims 34 may be positioned between the clamping bar 30 and the transom 14 to assist the clamping operation if the transom 14 is too narrow.

Referring again to FIGS. 1-2, the outboard motor mounting device 40 includes an integrally formed body 42 molded from a single master mold or fabricated with welded aluminum plates or any other suitable structural material. The body 42 includes a rear wall 44 and opposed side walls 46, 48 attached to the rear wall 44. The side walls 46, 48 are substantially parallel to each other and are spaced on opposite sides of the rear wall 44. A bottom surface, formed of two inclined bottom wall portions 50, 52, is attached to the rear wall 44 and extends between the side walls 46, 48. The bottom wall portions 50, 52 are inclined to approximate the shape of the hull of the boat 12. A mating front face 54 is spaced from the rear wall 44 and is attached to and extends between the side walls 46, 48. The front face 54 is also attached to the bottom surface 50, 52 and may be provided with scupper relief pockets 56 and a drain hole pocket 58 integrally molded into the front face 54. The scupper relief pockets 56 align with scuppers 59 in the transom 14. The front face 54 includes a mating surface 60 which is substantially flush with the transom 14, and a receiving indentation 62 which receives the attaching lip 78 of the swim platform 70. A mounting flange 64 extends on the uppermost portion of the rear wall 44 at least six inches above the location of the side walls 46, 48 to provide an adequately raised mounting section for the outboard motor.

The swim platform 70 forms the top surface of outboard motor mounting device 40 and includes a flat central portion 72 and may have flat platform extensions 74, 76 on either side of the central portion 72. The platform extensions 74, 76 may be provided such that the swim platform 70 extends substantially the entire width of the transom 14. The top surface of the swim platform 70 may be provided with a non-skid surface. An attaching lip 78, which is positioned on the forward end of the swim platform 70, interlocks with the receiving indentation 62 of the front face 54 to join the swim platform 70 to the body 42. A mounting flange 80 is provided in the aft section of the swim platform 70 and abuts the mounting flange 64 of the body portion 42. The mounting flange 64 of the body portion 42 and the mounting flange 80 of the swim platform 70 together provide a mounting surface for the outboard motor. Mounting flange 80 is positioned such that the attachment of the motor is at least six inches above the central portion 72 of the swim platform 70. This provides for the necessary clearance to tilt an outboard motor attached thereto and its connected control cables (not shown in the Figures) up, essentially out of the water. The swim platform 70 may include rigging hatches 82 to provide access into the hollow interior formed by the cooperation between the front face 54, the body 42 and the swim platform 70.

Figure 4:
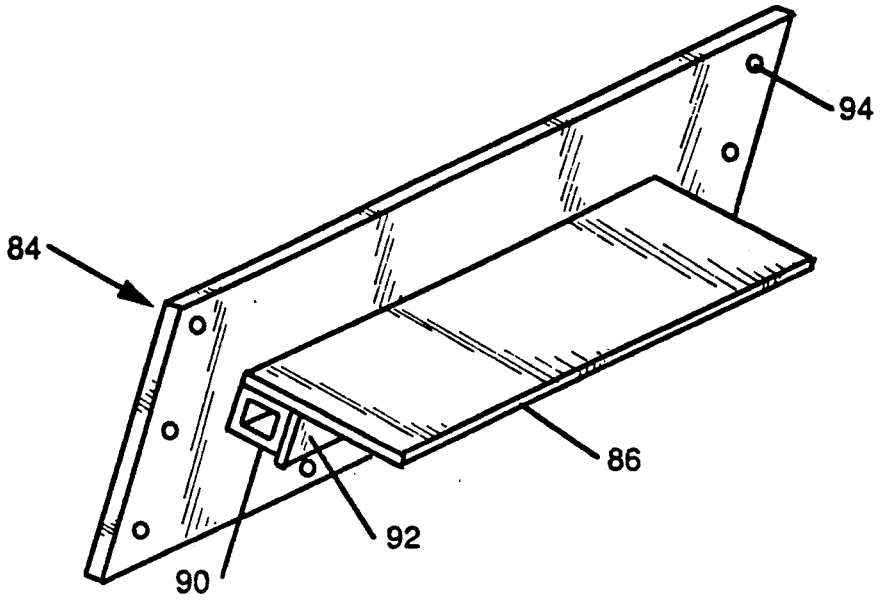
FIG. 4 is a perspective view of a second embodiment of the transom sealing bulkhead in accordance with the present invention.

FIG. 4 shows a forward view of a second embodiment of a transom sealing bulkhead. This transom sealing bulkhead 84 includes a bench 86 which may be integrally molded with a closing bulkhead 88. The bench 86 is positioned directly above a flange bracket 90 and a clamping bar 92. The bench 86 provides for additional seating within the boat 12 when the transom sealing bulkhead 84 is attached thereto. The transom sealing bulkhead 84 may include a plurality of bulkhead mounting holes 94 as shown in the previous embodiment.

Figure 5:
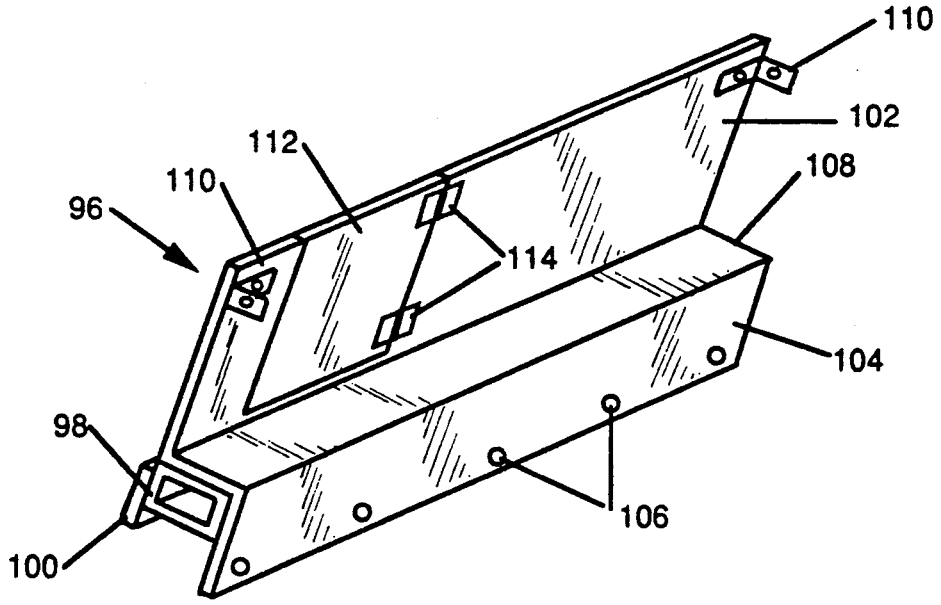
FIG. 5 is a perspective view of a third embodiment of the transom sealing bulkhead of the present invention.

FIG. 5 shows a third embodiment of a transom sealing bulkhead. The transom sealing bulkhead 96 of this embodiment has an overall Z-shape configuration which serves to increase the overall fore and aft depth of the swim platform 70 relative to the cockpit as well as provide a closing of the transom 14. A flange mounting assembly, which includes a flange bracket 98 and a clamping bar 100, overlays and abuts the horizontal transom lip 15 of the boat 12 and the transom sealing bulkhead 96 is located within the recess formed in the transom 14 above the horizontal transom lip 15. A lower portion of the transom sealing bulkhead 96 overlays the transom 14 and includes bulkhead mounting holes 106 as in the previous embodiments. An essentially horizontal portion 108 of the transom sealing bulkhead 96 attaches the lower portion 104 of the transom sealing bulkhead 96 to the upper portion 102 of the transom sealing bulkhead 96. The upper portion 102 and lower portion 104 of the transom sealing bulkhead 96 may be substantially parallel to each other. The connecting portion 108 of the transom sealing bulkhead 96 is substantially perpendicular to the upper and lower connected bulkheads 102, 104 such that the three transom sealing bulkhead members 102, 104 and 108 are arranged in a generally Z-shape configuration. Mounting brackets 110 may also be attached, preferably near the top of the upper transom sealing bulkhead 102, to securely fasten the upper transom sealing bulkhead 102 to the transom 14. An optional door 112, connected with door hinges 114 to the upper transom sealing bulkhead 102, allows easy access to the swim platform 70 and outboard motor mounting device 40. The door 112 may be incorporated into any of the transom sealing bulkheads 20, 84 or 96 illustrated.

Figure 6:
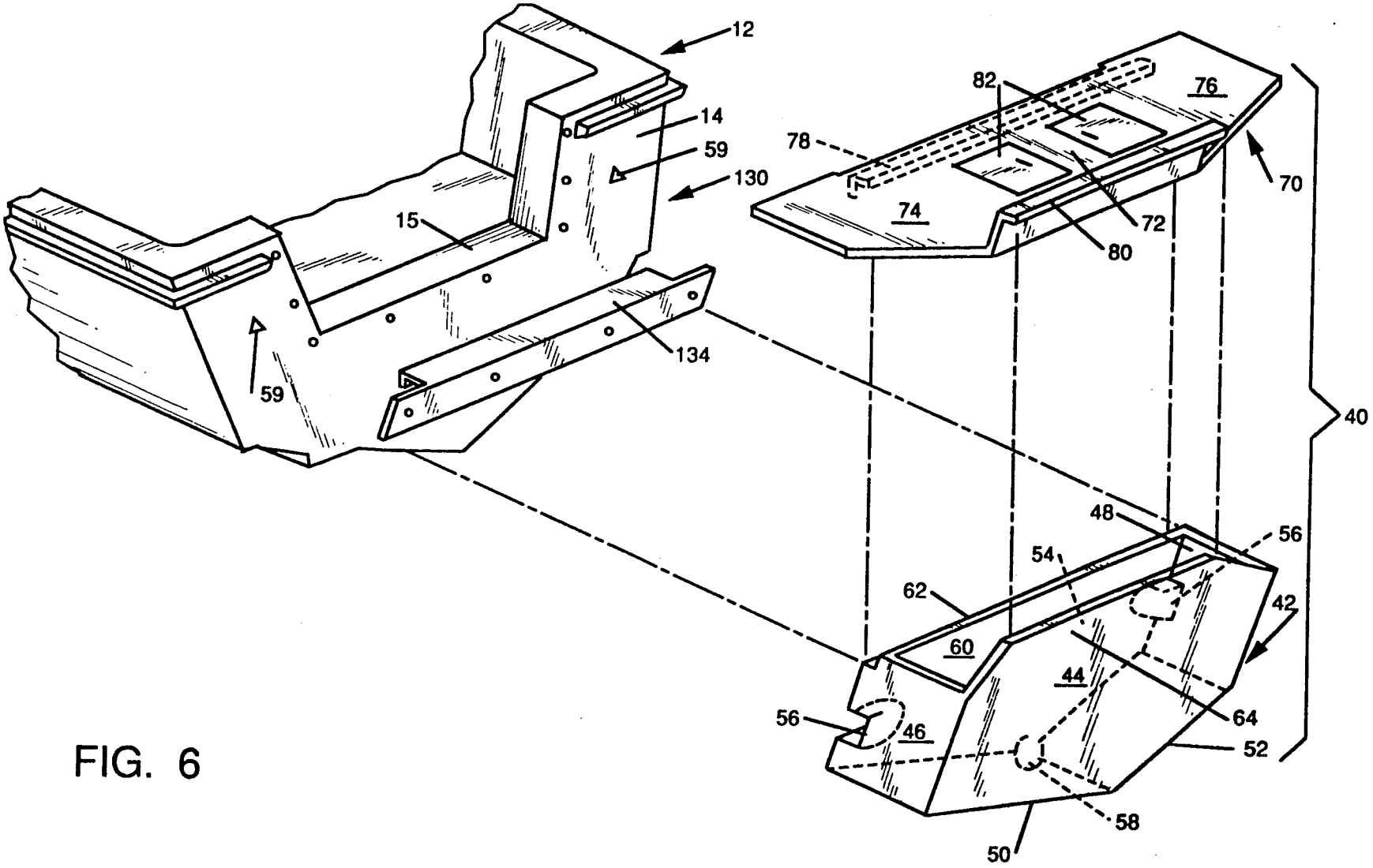
FIG. 6 is an exploded view of the outboard motor mounting device shown in FIGS. 1–2 used without a transom sealing bulkhead.

FIG. 6 shows an exploded view of the outboard motor mounting device 40, shown in FIGS. 1-2, utilized without a transom sealing bulkhead. The outboard motor mounting device 40 engages with a hanging bulkhead 130 rather than a transom sealing bulkhead. The hanging bulkhead 130 is made exactly like the lower portions of the transom sealing bulkhead 20 or 96. The hanging bulkhead includes a mounting flange assembly 134 which engages with the transom lip 15 of the boat 12. This system again allows the installer to simply hook the system on the transom for initial positioning, and assists the installation and positioning of the unit to give the proper height to the reinstalled motors. This specific arrangement may be preferred by swimmers and divers who wish to maintain an open transom for easy access, but incorporate the safety advantages of the added buoyancy of the unit.

Figure 7:
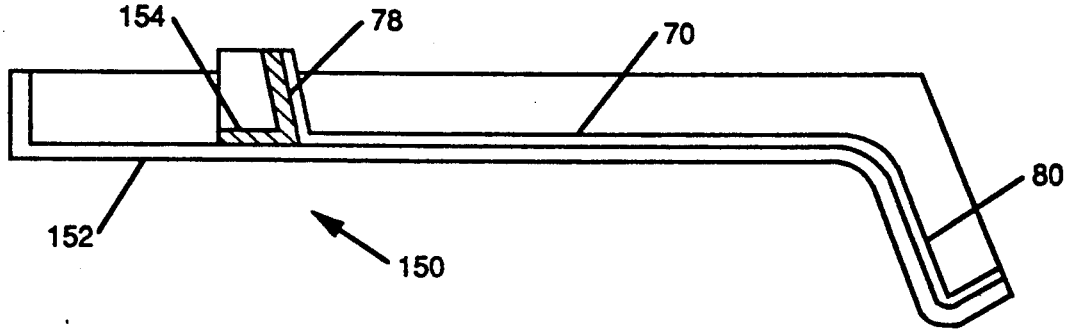
FIG. 7 is a cross section of a mold for forming the swim platform shown in FIGS. 1–2.

A mold 150 which can be used to manufacture the swim platform 70 is shown in FIG. 7. This mold 150 includes a primary mold 152 configured to mold a swim platform 70 of maximum length. A removable dam 154 is positioned within the primary mold 152 to provide for the molding of both the forward ends and the attaching lip 78 of swim platforms when swim platforms of shorter lengths are desired. This mold design allows for a swim platform of any length to be made within the single mold 150.

Figure 8:
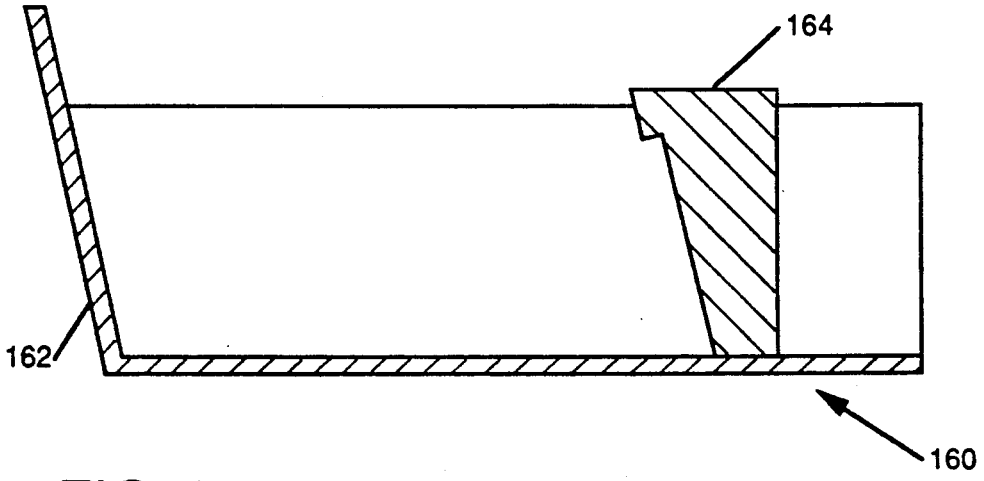
FIG. 8 is a cross section of a mold for forming the body shown in FIGS. 1–2.

A mold 160, which can be used to manufacture the body 42, is shown in FIG. 8. This mold 160 includes a primary mold 162 and a removable dam 164. The removable dam 164 is positioned at the desired length and orientation such that the front face 54 may be properly formed. The dam 164 also provides for the formation of any scupper relief pockets 56, drain hole pocket 58 or other items molded into the front face 54.

The outboard mounting device of the present invention extends approximately two to three feet behind the transom and has been proven to provide a significant performance increase in operating benefits over transom mounted engines. Cruising and top speed increases of five percent or more have been common for bracket equipped boats. The propellers operate more efficiently because they are running in less disturbed water by being further behind the transom. The additional distance of the propeller behind the transom permits the engine to be raised higher relative to the keel of the boat because the water behind the transom is rising. This results in a few inches less overall operating draft for boats with a properly designed buoyant bracket. At higher speeds, this additional height above the extended bottom of the boat can result in lower drag because less of the engine's lower drive unit is exposed to the water flow behind the transom of the boat.

The transom sealing bulkhead of the present invention quickly, easily and securely closes a cutout transom. The transom sealing bulkhead may be a widened upward extension of the forward mating bulkhead and is configured to overlap and seal the transom cutout up to the full height of the cockpit cover boards. This eliminates the costly necessity of having the opening structurally and/or cosmetically sealed.

The present configuration requires minimal preparation to mount the outboard mounting system. Generally, the simple removal of the trim around the opening sealing any holes covered by the units and a thorough cleaning and dewaxing of the transom in the mating areas is sufficient.

The transom sealing bulkhead of the present invention incorporates an integral positioning and mounting flange which greatly facilitates installation of the transom sealing bulkhead alone or together with the entire mounting system. The flange is designed to utilize the existing horizontal motor well transom lip to initially support and assist in the positioning of the outboard mounting system units during installation. A clamp attached to the flange may be drawn up tight to clamp the entire assembly to the boat transom, thereby aiding and simplifying the installation of the assembly when drilling the permanent mounting holes. The present design of the engine mounting system enables the engine thrust and running loads imposed by the engine, or engines, as well as the forces imposed on the mounting device itself, to be distributive over a maximum area of the transom surface, thereby minimizing any localized stressed areas.

The fully closed transom provided by the present system means greater safety offshore, minimizing the destabilizing effects of water in the cockpit. This is known as free surface effect. As the boat rolls from side-to-side, water in the cockpit runs to the low side greatly increasing the danger of capsizing. The transom sealing bulkhead of the present invention minimizes the chance of water coming over the transom.

The outboard motor mounting system of the present invention is designed with a sealed interior volume which gives more buoyancy and, thus, more stern lift than previously used brackets. As a wave approaches the transom from astern this extra buoyancy starts to lift the stern of the boat before the wave reaches the transom. This not only provides greater wave/boarding protection but it helps protect the outboard engine's powerheads from submerging. This added buoyancy allows the boat to sit at, or above, its original water line when the engine is tilted clear of the water.

The bottom surface of the present motor mounting system is preferably shaped to match the hull's V-shape and is raised three to six inches above and approximately parallel to the hull lines extending aft beyond the transom. This bottom shape gives several operating advantages: First, this eliminates the problem of the "rooster-tail" of water flowing upward off the transom under, and into, the cowling of the engine. This often occurs when accelerating from a stop or slow speed, or just as the boat comes "off-plane" when decelerating. This caused innumerable problems of water ingestion for engines mounted on prior bracket designs. Second, the V-shape of the bottom surface decreases re-entry forces on the mounting device when the boat is running fast and comes clear out of the water. When the boat comes back into the water, the V-shape of the bottom of the mounting device not only eases the water force on the mounting device, but it additionally forces the water to flow outward, rather than rearward, away from the bottom of the engines. Because the bottom surfaces do not angle upward from the transom, there is no tendency for it to act like a large "rocker surface" behind the transom which can affect the boat operation. Third, the present invention can help low speed operation by adding additional dynamic transom lift. Once the boat has achieved "on-plane" speeds the water flows clear of the bottom surface off the boat transom.

The top of the transom sealing bulkhead is preferably finished off flush with the stern cover boards on each side of the original motor well. The horizontal cap material is preferably a high density polyethylene with optional hand rails machined into its lip which project aft of the bulkhead to provide hand hold security for persons on the swim platform. The inboard top of the cap may also be designed as a cutting board.

The present mounting system provides an interrelationship between the major components which greatly increases the ease of manufacturing and versatility of the system. By constructing the body and the swim platform components on molds which are open in their forward ends, units of any length, angle and configuration can be constructed from one set of master molds. The length refers to the extension of the mounting device rearward from the transom, the angle refers to the appropriate angle to properly match the transom angle of the boat, and the configuration refers to specific clearance required between the main frame and/or the swim platform for transom mounted drains, scuppers, trim tab actuators or the like.

From the foregoing, it will be apparent that the outboard motor mounting device of the present invention has a number of advantages, some of which have been described above, and others of which are inherent in the invention. It will also be apparent from the foregoing that modifications can be made to the disclosed devices without departing from the teachings of the invention. Accordingly, the scope of the invention is only to be limited as necessitated by the accompanying claims.

I claim:

1. An outboard motor mounting system for mounting a motor on an outboard boat with a cutout transom, said system comprising:

a transom sealing means for sealing the cutout in said outboard boat's transom, said sealing means including a mounting flange which is adapted to be clamped to a horizontal motor well transom lip of said outboard boat to support and position said outboard motor mounting system;

an outboard motor mounting device which is attachable to the transom of the outboard boat, said outboard motor mounting device including a body and a swim platform which combine together to form a substantially sealed hollow interior to provide buoyancy to said mounting device; and said body includes a rear wall, two opposed side walls spaced from each other attached to said rear wall, a bottom surface extending between said side walls and attached to said rear wall, a mating front face spaced from said rear wall and attached to said side walls and said bottom surface, and a mounting flange located at an uppermost portion of said rear wall wherein said swim platform is an integral, one-piece member adapted to abut against a top surface of said opposed side walls to form said sealed hollow interior, and said mounting flange of said uppermost portion of said rear wall positioned above said top surface of said opposed side walls; further including a first receiving indentation provided on said front face which cooperates with an attaching lip provided on a forwardmost portion of said swim platform to securely fasten said swim platform to said front face.

2. The outboard motor mounting system of claim 1 further including a door within said transom sealing means permitting access to said swim platform of said outboard motor mounting device.

3. The outboard motor mounting system of claim 1 wherein said transom sealing means includes a bench portion attached to an outer surface thereof.

4. The outboard motor mounting system of claim 1 wherein said transom sealing means includes an upper transom sealing bulkhead member, a lower transom sealing bulkhead member, and a connecting transom sealing bulkhead member attached to both the upper transom sealing bulkhead member and said lower transom sealing bulkhead member wherein said transom sealing bulkhead members combine in a general Z-shape configuration to seal said transom.

5. The outboard motor mounting system of claim 1 wherein said swim platform has at least one rigging hatch therethrough into said substantially sealed hollow interior.

6. The outboard motor mounting system of claim 1 wherein said front face is integral with said body.

7. The outboard motor mounting system of claim 1 further including a mounting flange attached to said swim platform and cooperating with said mounting flange of said body to form a motor mounting portion above said substantially sealed hollow interior whereby the outboard motor may be securely fastened to said mounting flanges at a location above said substantially sealed hollow interior.

8. The outboard motor mounting system of claim 7 further including integral scupper relief pockets provided in said front face which cooperate with scuppers formed in said outboard boat.

9. The outboard motor mounting system of claim 7 wherein said bottom surface is formed of two inclined bottom wall portions.

10. The outboard motor mounting system of claim 7 further including an integral drain hole pocket provided in said front face.

11. The outboard motor mounting system of claim 7 wherein said swim platform includes platform extensions on opposed sides of said swim platform at a position above said top surface of said opposed side walls wherein said swim platform extends substantially the entire width of the transom.

12. The outboard motor mounting system of claim 7 wherein said front face is integral with said body.

13. An outboard motor mounting device for mounting a motor on an outboard boat and which is attachable to a transom of said boat, said device comprising a body and a swim platform which combine together to form a substantially sealed hollow interior to provide buoyancy to said mounting device;

said body includes a rear wall, two opposed side walls spaced from each other attached to said rear wall, a bottom surface extending between said side walls and attached to said rear wall, a mating front face spaced from said rear wall and attached to said side walls and said bottom surface, and a mounting flange located at an uppermost portion of said rear wall, wherein said swim platform is an integral, one-piece member adapted to abut against a top surface of said opposed side walls to form said sealed hollow interior, and said mounting flange of said uppermost portion of said rear wall positioned above said top surface of said opposed side wall;

said swim platform including platform extensions on opposed sides of said swim platform at a position above said top surface of said opposed side walls wherein said swim platform extends substantially the entire width of the transom, wherein a first receiving indentation is provided on said front face which cooperates with an attaching lip provided on a forward most portion of said swim platform to securely fasten said swim platform to said front face; and further including a mounting flange attached to said swim platform and cooperating with said mounting flange of said body to form a motor mounting portion above said substantially sealed hollow interior and said top surface of said opposed sides whereby the outboard motor may be securely fastened to said mounting flanges at a location above said substantially sealed hollow interior and said top surface of said opposed sides.

14. The outboard motor mounting device of claim 13 further including a hanging bulkhead coupled to said body and said swim platform.

15. The outboard motor mounting device of claim 14 wherein said hanging bulkhead includes a mounting flange assembly which clamps on the transom lip of a boat.

* * * * *